US007598466B2

(12) United States Patent
Tateda et al.

(10) Patent No.: US 7,598,466 B2
(45) Date of Patent: Oct. 6, 2009

(54) KEY SHEET

(75) Inventors: Shinya Tateda, Fukushima-prefecture (JP); Junko Hosaka, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 113 days.

(21) Appl. No.: 11/826,778

(22) Filed: Jul. 18, 2007

(65) Prior Publication Data

US 2008/0017495 A1 Jan. 24, 2008

(30) Foreign Application Priority Data

Jul. 20, 2006 (JP) ..... 2006-198784

(51) Int. Cl.
*H01H 3/12* (2006.01)

(52) U.S. Cl. ..... 200/341; 200/512

(58) Field of Classification Search ..... 200/310–345, 200/512–520, 5 A

See application file for complete search history.

(56) References Cited

U.S. PATENT DOCUMENTS

| | | | | |
|---|---|---|---|---|
| 4,359,612 | A * | 11/1982 | Rooney | 200/5 R |
| 6,734,382 | B2 * | 5/2004 | Arai et al. | 200/512 |
| 6,858,812 | B2 * | 2/2005 | Sasaki et al. | 200/344 |
| 6,946,611 | B2 * | 9/2005 | Yoneyama | 200/515 |
| 7,034,235 | B2 * | 4/2006 | Hosaka | 200/314 |
| 7,099,465 | B2 * | 8/2006 | Nishi | 379/433.07 |
| 7,297,221 | B2 * | 11/2007 | Hikita | 156/240 |
| 7,358,454 | B2 * | 4/2008 | Senzui | 200/341 |
| 7,378,607 | B2 * | 5/2008 | Koyano et al. | 200/341 |

FOREIGN PATENT DOCUMENTS

| | | | |
|---|---|---|---|
| EP | 0 163 149 | A2 | 12/1985 |
| EP | 0 163 149 | A3 | 12/1985 |
| EP | 0 977 225 | A2 | 2/2000 |
| EP | 0 977 225 | A3 | 2/2000 |
| EP | 1 137 028 | A2 | 9/2001 |
| EP | 1 244 125 | A1 | 9/2002 |
| EP | 1 137 028 | A3 | 3/2004 |

(Continued)

OTHER PUBLICATIONS

Communication from European Patent Office for application No. 07013437.4 dated Feb. 5, 2008.

*Primary Examiner*—Michael A Friedhofer
*Assistant Examiner*—Lisa N Klaus
(74) *Attorney, Agent, or Firm*—Cermak Kenealy Vaidya & Nakajima LLP; Tomoko Nakajima

(57) ABSTRACT

Disclosed is a thin key sheet in which the adhesive is prevented from being squeezed out and in which adhesive marks and bubble marks are hard to be visible. An adhesive layer is in a dot pattern formed by a plurality of dots spaced apart from each other by gaps, so when attaching a key top and a base sheet to each other through an intermediation of the adhesive layer, it is possible to allow air to escape through the gaps, and bubbles recognizable to a naked eye are not easily trapped by the interior of the adhesion layer or an interface between the adhesive layer and the key top. Further, since the adhesive layer is a screen print layer, a dimension of elements of fine pattern thereof can be on an order of microns, thereby making the fine pattern of the adhesive layer hard to be visible through the key top.

19 Claims, 7 Drawing Sheets

FOREIGN PATENT DOCUMENTS

| | | | |
|---|---|---|---|
| EP | 1 548 777 | A1 | 6/2005 |
| JP | 2003-297181 | | 10/2003 |
| JP | 2003-297181 | A | 10/2003 |
| JP | 2005-050709 | | 2/2005 |
| JP | 2005-050709 | A | 2/2005 |

* cited by examiner

KEY SHEET

BACKGROUND OF THE INVENTION

1. Field of the Invention

The present invention relates to a key sheet for pushbutton key switches for use in operating portions of various electronic apparatuses such as a mobile phone, a PDA, and an AV apparatus, in particular, to a key sheet in which pushbutton key tops and a base sheet are firmly bonded together by means of adhesive.

2. Description of the Related Art

As a pushbutton switch key sheet for a portable communications apparatus such as a mobile phone, there is widely used a so-called illumination type key sheet which is composed of a translucent key top and a translucent base sheet and which effects illumination with light from within the apparatus. In this illumination type key sheet, the translucent key top and the translucent base sheet are bonded together by using translucent adhesive.

The adhesive is applied to the bonding surface of the key top or that of the base sheet by a dispenser, screen printing, etc. If the amount of adhesive applied is rather small, an unsightly adhesive mark 2 becomes visible on the back side of the key top 1 as shown in FIG. 8. In view of this, when performing adhesive application by the dispenser, a relatively large amount of adhesive is used. This may result in some adhesive being squeezed out of the bonding surface of the key top and the base sheet; the adhesive thus squeezed out may adhere to the periphery of the bonding surface of the base sheet to be cured thereon. Then, the base sheet will be deformed in an unbalanced fashion at the time of depressing operation, making it rather difficult to perform the depressing operation. Thus, as a technique for preventing the adhesive from being squeezed out, JP 2003-297181 A discloses a key unit structure in which a bank-like protrusion is provided on the bonding surface of the key top or that of the base sheet. Further, JP 2005-50709 A discloses a key sheet in which an adhesive accumulation groove is formed in the bonding surface of the key top or that of the base sheet. In the case of screen printing, the adhesive is applied very thinly and two-dimensionally to the entire bonding surface of the key top or of the base sheet, making the adhesive mark hard to be visible while preventing the adhesive from being squeezed out.

However, in the key unit structure disclosed in JP 2003-297181 A, the key unit is rather thick due to the provision of the protrusion on the bonding surface of the key top and of the base sheet. In the key sheet disclosed in JP 2005-50709 A, it is necessary for the key top or the base sheet to be thick enough to allow formation of a groove. Thus, in both of the conventional techniques, it is rather difficult to achieve a reduction in thickness. Further, as shown in FIG. 9, in the case of adhesive application by screen printing, the outer edge of an adhesive layer 3 is raised after the application as shown in FIG. 9. Thus, when bonding the key top 1 and the base sheet 4 to each other, bubbles are easily allowed to be mixed into the interface of the adhesive layer 3 after the application. As a result, as shown in FIG. 10, bubble marks 5 are visible through the key top 1, causing additional inconvenience.

SUMMARY OF THE INVENTION

The present invention has been made in view of the above-mentioned problems in the prior art. It is accordingly an object of the present invention to provide a thin key sheet in which the adhesive is prevented from being squeezed out and in which adhesive marks and bubble marks are relatively inconspicuous.

In order to achieve the above-mentioned object, the present invention is constructed as follows. That is, the present invention provides a key sheet including: a key top; a base sheet to which the key top is fixed; and an adhesive layer existing between the key top and the base sheet, in which the adhesive layer is a print layer in a fine pattern formed by pattern elements spaced apart from each other by gaps.

In the present invention, the fine-pattern elements of the adhesive layer are spaced apart from each other by gaps, so when bonding the key top and the base sheet to each other through the intermediation of the adhesive layer, it is possible to allow air to escape through the gaps. Thus, the interior of the adhesive layer, and the interface between the adhesive layer and the key top, or the interface between the adhesive layer and the base sheet can be made relatively free from trapping of bubbles visually recognizable to the naked eye. The present invention does not aim to completely eliminate bubbles from the interface of the adhesive layer; bubbles may exist in the interface of the adhesive layer as long as they are ones unrecognizable to the naked eye.

Further, since the adhesive layer is a print layer, the fine-pattern elements of the adhesive layer can be on the order of microns. Thus, it is possible to make the fine pattern of the adhesive layer hard to be visible through the key top, making the adhesive marks hard to visually recognize. The expression: "on the order of microns" implies a dimension of less than 1 mm, which means the line width etc. of the fine-pattern elements is of a dimension of less than 1 mm.

In the key sheet of the present invention, the adhesive layer is formed in a regular line pattern or dot pattern in plan view. When the pattern of the adhesive layer is irregular, for example, when circular pattern elements are arranged in an irregular fashion, there is a difference in light transmission property or the like between a region where dot pattern elements are densely arranged and a region where they are sparse, resulting in generation of unevenness in density, which appears to be an adhesive mark. According to the present invention, line pattern elements or dot pattern elements are arranged in a regular fashion, so the light transmission property, etc. can be made uniform. Thus, it is possible to prevent generation of unevenness in density looking like an adhesive mark.

In the key sheet of the present invention, the area proportion of the adhesion surface adhering to the adhesive layer with respect to the bonding surface of the base sheet for the key top ranges from 30% to 80%. This range allows escape of air through the gap, making it possible to fix the key top and the base sheet to each other reliably. If the area proportion of the adhesion surface adhering to the adhesive layer with respect to the bonding surface of the base sheet for the key top is less than 30%, the adhesive force is rather small, and the adhesive layer is liable to be peeled off from the base sheet. When the proportion is in excess of 80%, the gaps are rather small, and are crushed by the pressure when bonding the key top and the base sheet to each other, so there is a fear of bubbles being trapped in the interior of the adhesive layer.

In the key sheet of the present invention, the key top has at its bottom a diffusion layer diffusing transmitted light. That is, the adhesive layer is visually recognized through the diffusion layer, so the pattern configuration of the adhesive layer can be made hard to visually recognize.

It is desirable for the adhesive layer of the key sheet of the present invention to contain 0.1% by mass to 15% by mass of an inorganic additive with respect to the resin solid portion.

This helps to impart a thixotropy property to the adhesive before curing, making it possible to prevent dripping, spreading, crumbling, etc. of the adhesive. Thus, it is possible to easily form an adhesive layer of a regular fine pattern. When the amount of inorganic additive is less than 0.1% by mass, it is impossible to impart a thixotropy property to the adhesive, whereas, when it is in excess of 15% by mass, the adhesive layer is blurred and hard to print, and becomes rather fragile after curing.

In the adhesive layer of the key sheet of the present invention, it is desirable for the line width of the line pattern elements and the diameter or diagonal length of the dot pattern elements to range from 100 μm to 500 μm. This range makes it possible to swell the adhesive after the pattern application in a dome-like fashion by surface tension. Thus, it is possible to bond the key top and the base sheet to each other by press-fitting while crushing the adhesive swollen in a dome-like fashion, making it possible to bond them together while extruding air from the interface of the adhesive layer. When the line width, etc. is in excess of 500 μm, it is impossible to form a dome-like swelling by surface tension, and the outer edge of the adhesive is raised after the pattern application as shown in FIG. 9, thus allowing bubbles to be easily trapped in the interface of the adhesive layer. When it is less than 100 μm, blurring or partial lack of ink is generated at the time of printing, so it may be impossible to accurately form a high-quality fine pattern.

In the key sheet of the present invention, when bonding the key top and the base sheet to each other through the intermediation of the adhesive layer, it is possible to allow air to escape through the gaps formed therebetween. Thus, the interior of the adhesive layer and the interface between the adhesive layer and the key top or between the adhesive layer and the base sheet can be made relatively free from trapping of bubbles visually recognizable to the naked eye. Thus, it is possible to realize a key sheet in which bubble marks are hard to be visible.

Further, since the adhesive layer is a print layer, it is possible to prevent the adhesive from being squeezed out. Further, the dimension of the fine-pattern elements of the adhesive layer can be on the order of microns, thus making the fine pattern of the adhesive layer hard to be visible through the key top. Thus, it is possible to realize a key sheet in which the adhesive is hard to visually recognize.

The description of the present invention should not be construed restrictively; the advantages, features, and uses of the present invention will become more apparent from the following description with reference to the accompanying drawings. Further, it should be understood that all modifications made without departing from the gist of the present invention are to be covered by the scope of the present invention.

DESCRIPTION OF THE PREFERRED EMBODIMENTS

Figure 1:
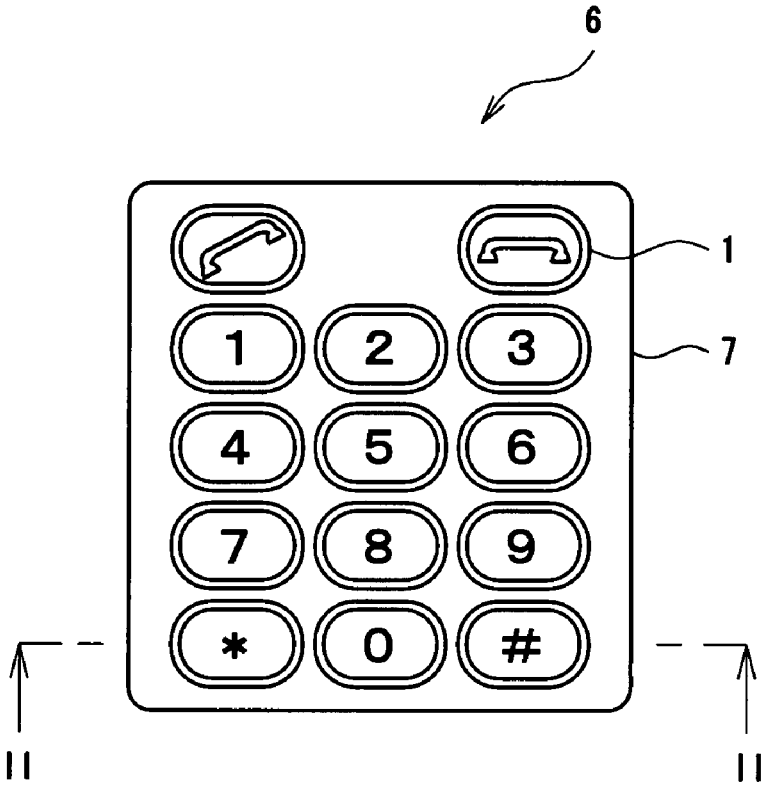
FIG. 1 is a plan view of a key sheet according to a first embodiment of the present invention.
Figure 2:
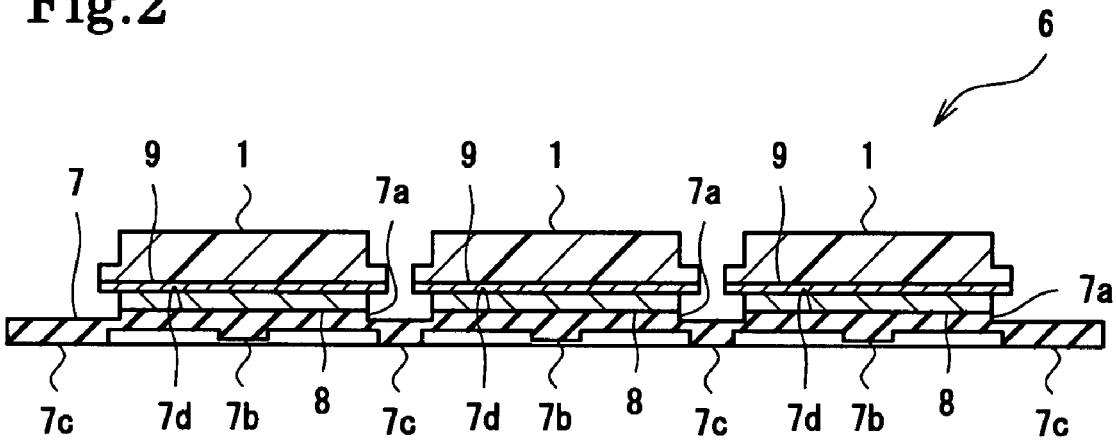
FIG. 2 is a sectional view taken along the line II-II of FIG. 1.
Figure 3:
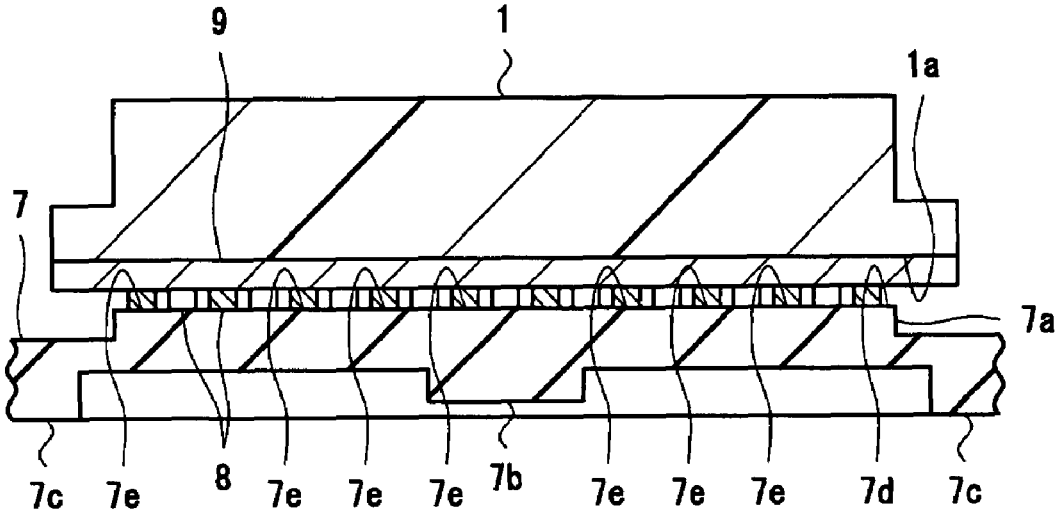
FIG. 3 is an enlarged sectional view of the key sheet of the first embodiment.
Figure 4:
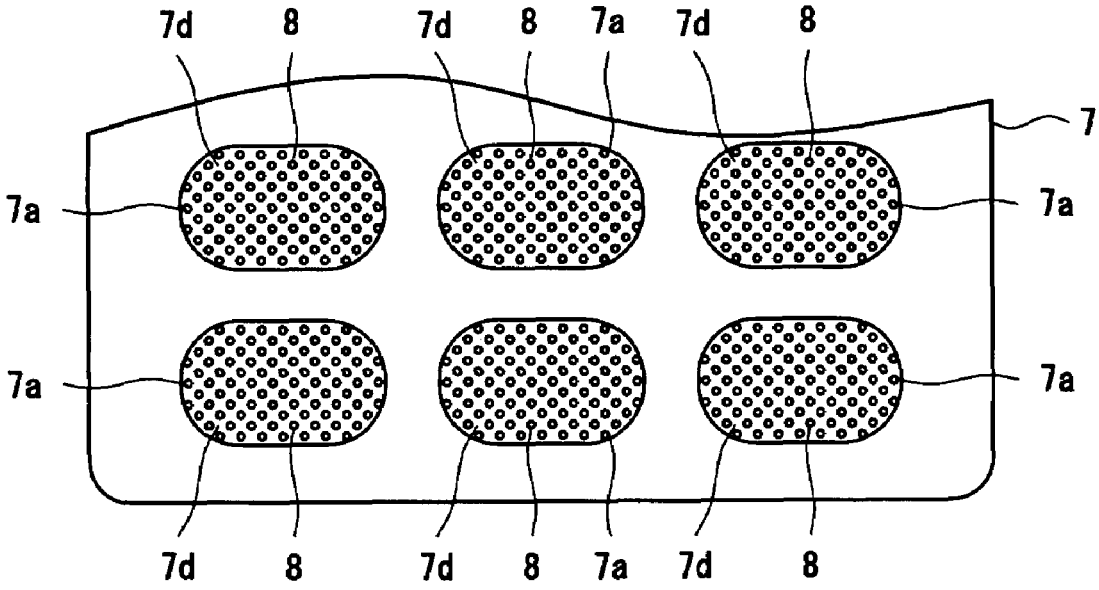
FIG. 4 is a plan view illustrating adhesive layers of the key sheet of the first embodiment.

Hereinafter, embodiments of the present invention will be described with reference to the drawings. In the drawings, the reference numerals indicate portions and components of the embodiments. The portions and components common to the embodiments are indicated by the same reference numerals, and a redundant description thereof will be omitted.

First Embodiment

FIGS. 1 through 5

FIGS. 1 through 5 show a key sheet 6 according to a first embodiment. The key sheet 6 of the first embodiment is equipped with key tops 1, a base sheet 7, and adhesive layers 8.

The key tops 1 are formed of a transparent resin such as a polycarbonate resin; on their back surfaces 1*a* opposed to the base sheet 7, there are provided display layers 9 having numbers, symbols, etc. thereon.

The base sheet 7 is formed of a translucent silicone rubber, and seat portions 7*a* to which the key tops 1 are to be fixed are formed on the front surface, i.e., the depressing operation side surface thereof. On its back surface, i.e., the surface on the side opposite to the front surface, there protrude, in correspondence with the seat portions 7*a*, pusher portions 7*b* for depressing contact switches, such as metal belleville springs (not shown), and leg portions 7*c* surrounding the pusher portions 7*b*. The distal ends of the leg portions 7*c* are placed on the surface of a board (not shown).

The adhesive layers 8 are formed of an acrylic type ultraviolet curing adhesive; they are formed in a dot pattern in which minute dots circular in plan view are arranged in a regular fashion. That is, the dots are provided so as to form gaps at equal intervals with respect to the surfaces 7*d* of the seat portions 7*a*. It is desirable for the area proportion of the adhesion surfaces 7*e* adhering to the adhesive layers 8 with respect to the surfaces 7*d* of the seat portions 7*a* serving as the "bonding surfaces" of the base sheet 7 to range from 30% to 80%; in this embodiment, this proportion is 30%. Further, 10% by mass of silica is added to the resin solid portion of the acrylic type ultraviolet curing adhesive. The diameter of the dots preferably ranges from 100 μm to 500 μm, and their thickness preferably ranges from 5 μm to 30 μm. In this embodiment, the dots have an outer diameter of 300 μm and a thickness of 10 μm.

Here, the materials of the components of the key sheet 6 will be described. The following description will also be applicable to the other embodiments described below.

It is desirable for the material used in forming the key tops 1 to be a thermoplastic resin or a reactive curing resin from the viewpoint of the requisite performance such as mechanical strength and durability, and a reduction in weight. Examples of the resin that can be used in this embodiment include apart from a polycarbonate resin, a polymethyl methacrylate resin, a polypropylene resin, a polystyrene resin, a polyacryl copolymer resin, a polyolefin resin, an acrylonitrile butadiene styrene resin, a polyester resin, an epoxy resin, a polyurethane resin, a polyamide resin, and a silicone resin. Further, taking transparency into consideration, a polycarbonate resin, a polymethyl methacrylate resin, and a acrylic copolymer resin are preferable.

It is desirable for the material used in forming the base sheet 7 to be a rubber of high rebound resilience or a thermoplastic elastomer. Examples of the rubber apart from a silicone rubber that can be used in this embodiments include, a natural rubber, an ethylene propylene rubber, a butadiene rubber, an isoprene rubber, a chloroprene rubber, and a urethane rubber, and examples of the thermoplastic elastomer that can be used include a styrene type thermoplastic elastomer, an olefin type thermoplastic elastomer, an ester type thermoplastic elastomer, a urethane type thermoplastic elastomer, an amide type thermoplastic elastomer, a butadiene type thermoplastic elastomer, an ethylene-vinyl-acetate type thermoplastic elastomer, a fluoro-rubber type thermoplastic elastomer, an isoprene type thermoplastic elastomer, and a chlorinated polyethylene type thermoplastic elastomer. Further, taking its low temperature dependence into consideration, a silicone rubber is preferable.

It is desirable for the material forming the adhesive layers 8 to be a resin having high mechanical strength and durability. Examples of the resin that can be used include a urethane type resin, an epoxy type resin, an amino type resin, an acrylic type resin, a cyanoacrylate type resin, a vinyl chloride type resin, and an ester type resin. In the case of an illumination type key sheet, a translucent resin is used.

Next, an example of the method of manufacturing the key sheet 6 of the first embodiment will be described. First, silicone rubber is charged into the mold for molding the base sheet 7 to form the base sheet 7. Then, an acrylic type ultraviolet curing adhesive is applied to the surfaces 7*d* of the seat portions 7*a* of the base sheet 7 by screen printing. On the other hand, the key tops 1 of polycarbonate resin are formed by injection molding, and the display layers 9 are provided on their back surfaces 1*a*. Finally, the back surfaces 1*a* of the key tops 1 are press-fitted to the surfaces 7*d* of the seat portions 7*a* through the intermediation of the adhesive, and then ultraviolet light is applied from the back side of the base sheet 7 to cure the adhesive, whereby the key sheet 6 is obtained.

Finally, the effects of the key sheet 6 of this embodiment will be described.

In the key sheet 6 of the first embodiment, the adhesive layers 8 is composed of dot pattern layers formed by a plurality of dots spaced apart from each other by gaps. Thus, when bonding the key tops 1 and the base sheet 7 to each other through the intermediation of the adhesive layers 8, it is possible to allow air to escape through the gaps, thus making the interior of the adhesive layers 8 and the interfaces between the adhesive layers 8 and the key tops 1 relatively free from trapping of bubbles visually recognizable to the naked eye.

Further, since the adhesive layers 8 are screen print layers 8, the fine-pattern element dimension of the adhesive layers 8 can be on the order of microns. Thus, the fine pattern of the adhesive layers 8 can be made hard to be visible through the key tops 1, so the adhesive marks, which are to be observed in the prior art, can be made hard to visually recognize.

Since the dots of the adhesive layers 8 are arranged in a regular dot pattern, it is possible to attain a uniform light transmission property, etc. Thus, it is possible to prevent generation of unevenness in density, such as adhesive marks as observed in the prior art.

Since the proportion of the adhesion surfaces 7*e* adhering to the adhesive layers 8 with respect to the surfaces 7*d* of the seat portions 7*a* of the base sheet 7 is 30%, it is possible to allow air to escape through the gaps, making it possible to fix the key tops 1 to the base sheet 7 reliably.

Since the adhesive layers 8 contain 10% by mass of silica with respect to the resin solid portion, it is possible to impart a tixotropy property to the adhesive prior to curing, making it possible to prevent the adhesive from dripping, spreading, crumbling, etc. Thus, it is possible to realize adhesive layers 8 of a regular fine pattern.

Figure 5:
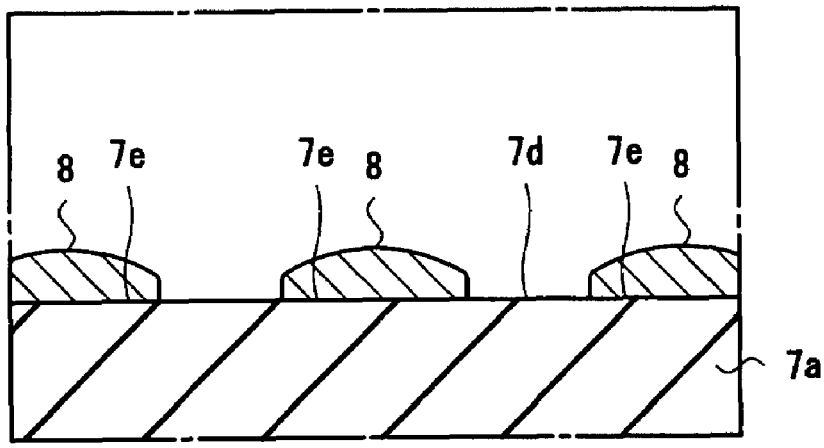
FIG. 5 is an enlarged sectional view illustrating the adhesive layers of the key sheet of the first embodiment.

Since the diameter of the circular dots is 300 μm, it is possible for the dots formed of adhesive to swell in a dome-like fashion as shown in FIG. 5 by surface tension after pattern application. Thus, the key tops 1 and the base sheet 7 can be press-fitted to each other while crushing the adhesive swollen in a dome-like fashion, whereby it is possible to attach them to each other while expelling air through the interfaces of the adhesive layers 8.

Second Embodiment

FIG. 6

Figure 6:
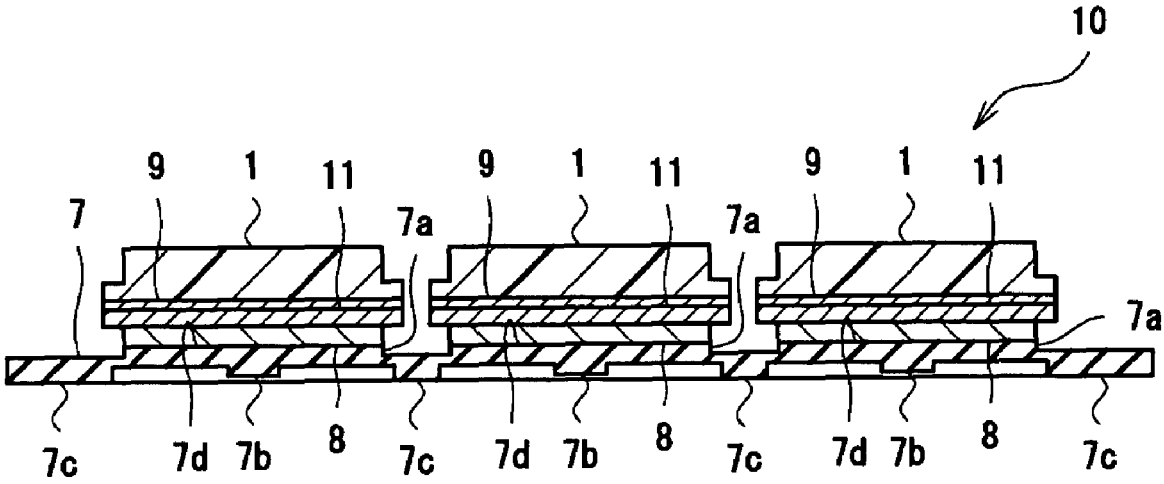
FIG. 6 is a sectional view, corresponding to FIG. 2, of a key sheet according to a second embodiment of the present invention.

FIG. 6 shows a key sheet 10 according to a second embodiment. The key sheet 10 of the second embodiment differs from the key sheet 6 of the first embodiment in that diffusion layers 11 are provided on the back surfaces of the key tops 1. Otherwise, this embodiment is of the same construction and effects as the first embodiment.

The diffusion layers 11 are formed of an acrylic/polycarbonate type resin, and are provided on the back surfaces of the display layers 9.

The material used for forming the diffusion layers 11 is a resin that can be fixed to the key tops 1 or the display layers 9. Examples of the resin that can be used include an acrylic resin, a vinyl type resin, an ester type resin, an acrylic/polycarbonate type resin, an acrylonitrile-butadiene-styrene/styrene type resin, a urethane type resin, an olefin type resin, an epoxy type resin, and an alkyd type resin. Particles of calcium carbonate, crosslinked polymethyl methacrylate, crosslinked polystyrene, barium sulfide, silicone, titanium oxide, mica, bismuth oxychloride, etc. are dispersed in the resin singly or in combination. Among those, if dispersed in the resin, particles of mica and bismuth oxychloride help to impart not only the light diffusion effect but also a pearly gloss to the resin. It is desirable for the grain size of these particles to range from 0.1 μm to 50 μm. With a grain size of less than 0.1 μm, it is rather difficult to effect uniform dispersion, which means a uniform dispersion effect is hard to obtain. When the grain size is in excess of 50 μm, the surface asperity of the diffusion layers 9 is rather conspicuous, and bubbles are liable to be trapped in the interfaces between them and the adhesive layers 8. It is desirable for the content of the particles to range from 1.0% by mass to 30% by mass with respect to the resin. When the content is less than 1.0% by mass, the intended light diffusion effect is hard to obtain, whereas when it exceeds 30% by mass, the total light transmissivity is reduced, and the transmitted light becomes rather dark.

Here, an example of the method of manufacturing the key sheet 10 of the second embodiment will be described. First, as in the first embodiment, silicone rubber is charged into the mold for molding the base sheet 7 to form the base sheet 7. Then, an acrylic type ultraviolet curing adhesive is applied to the surfaces 7*d* of the seat portions 7*a* of the base sheet 7 by screen printing. On the other hand, as in the first embodiment, the key tops 1 of polycarbonate resin are formed by injection molding, and the display layers 9 are provided on the back surfaces 1*a* thereof before the diffusion layers 11 are formed on the back surfaces of the display layers 9. Finally, the back surfaces 1*a* of the key tops 1 are press-fitted to the surfaces 7*d* of the seat portions 7*a* through the intermediation of the adhesive, and then ultraviolet light is applied from the back surface side of the base sheet 7 to cure the adhesive, whereby the key sheet 10 can be obtained.

The key sheet 10 of the second embodiment can provide the same effects as those of the key sheet 6 of the first embodiment; further, it provides the following effect.

In the key sheet 10, the key tops 1 have on the back surfaces 1*a* thereof the diffusion layers 11 for diffusing transmitted light, so the adhesive layers 8 have to be visually recognized through the diffusion layers 11, and the pattern configuration of the adhesive layers 8 and the bubbles at the interface of the adhesive layers 8 can be made hard to visually recognize. Thus, the adhesive marks and bubble marks can be made hard to visually recognize.

Modifications Common to the Embodiments

FIGS. 7A through 7F

Figure 7A:
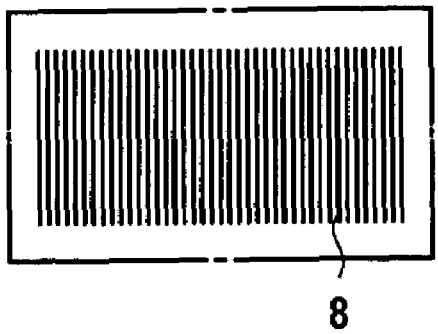
FIGS. 7A through 7F are enlarged plan views illustrating modifications of the adhesive layer.
Figure 7B:
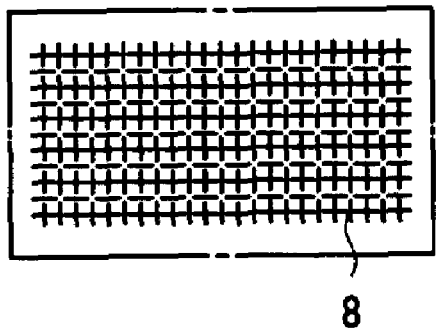
Figure 7C:
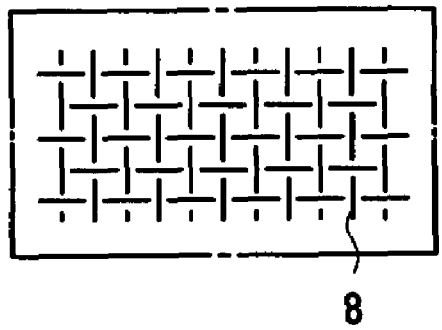
Figure 7D:
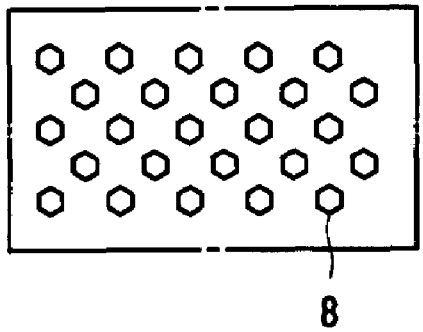
Figure 7E:
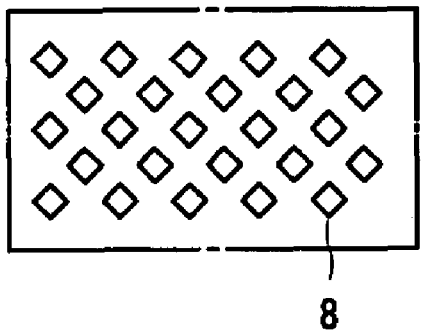
Figure 7F:
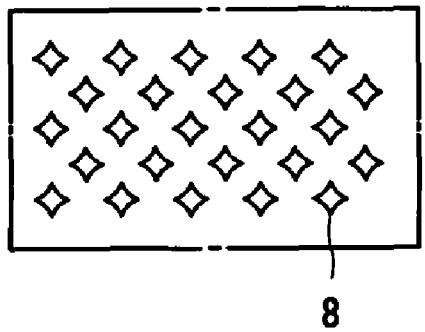
Figure 8:
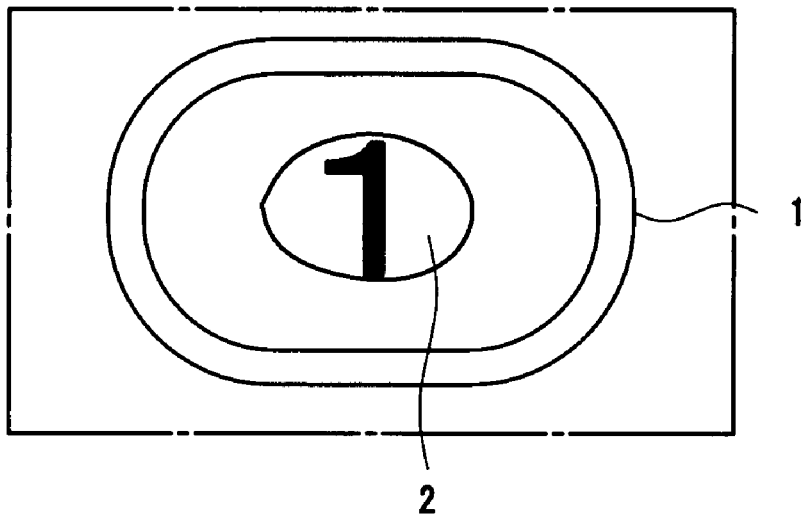
Fig.8 Related Art
FIG. 8 is a plan view of a conventional key sheet.

While in the respective key sheets 6 and 10 of the first and second embodiments the adhesive layers 8 are formed in a dot pattern composed of circular dots in plan view, the following modifications are also possible. FIG. 7A shows a striped line pattern composed of parallel straight lines. FIG. 7B shows a lattice-like line pattern composed of straight lines. FIG. 7C shows a meshed line pattern composed of straight lines. FIG. 7D shows a dot pattern formed by polygonal dots. FIG. 7E shows a dot pattern formed by rectangular dots. FIG. 7F shows a dot pattern composed of dots in the form of polygonal figures with inwardly recessed arcuate sides.

EXAMPLES

Next, the present invention will be described in more detail with reference to specific examples and comparative examples. The present invention, however, is not restricted to the following examples.

1. Manufacture of the Key Sheet

Example 1

Silicone rubber is charged into the mold for molding the base sheet 7 to form the base sheet 7. Then, an acrylic type ultraviolet curing adhesive is applied to the surfaces 7*d* of the seat portions 7*a* of the base sheet 7 by screen printing. The adhesive layers 8 in this case are formed in a dot pattern in which circular dots having an outer diameter of 300 μm are arranged, and the area proportion of the adhesion surfaces 7*e* adhering to the adhesive layers 8 with respect to the surfaces 7*d* of the seat portions 7*a* is 30%. On the other hand, the key tops 1 of a polycarbonate resin are formed by injection molding, and the display layers 9 are provided on the back surfaces 1*a* thereof. Finally, the back surfaces 1*a* of the key tops 1 are press-fitted to the surfaces 7*d* of the seat portions 7*a* through the intermediation of the adhesive, and then ultraviolet light is applied from the back surface side of the base sheet 7 to cure the adhesive, thereby producing the key sheet of Example 1.

Example 2

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 300 μm are arranged, and the area proportion of the adhesion surfaces 7*e* adhering to the adhesive layers 8 with respect to the surfaces 7*d* of the seat portions 7*a* is 50%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Example 2.

Example 3

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 300 μm are arranged, and the area proportion of the adhesion surfaces 7*e* adhering to the adhesive layers 8 with respect to the surfaces 7*d* of the seat portions 7*a* is 80%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Example 3.

Example 4

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 100 μm are arranged, and the area proportion of the adhesion surfaces 7*e* adhering to the adhesive layers 8 with respect to the surfaces 7*d* of the seat portions 7*a* is 80%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Example 4.

Example 5

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 500 μm are arranged, and the area proportion of the adhesion surfaces 7*e* adhering to the adhesive layers 8 with respect to the surfaces 7*d* of the seat portions 7*a* is 80%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Example 5.

Comparative Example 1

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 300 μm are arranged, and the area proportion of the adhesion surfaces 7*e* adhering to the adhesive layers 8 with respect to the surfaces 7*d* of the seat portions 7*a* is 20%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Comparative Example 1.

Comparative Example 2

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 300 μm are arranged, and the area proportion of the adhesion surfaces 7*e* adhering to the adhesive layers 8 with respect to the surfaces 7*d* of the seat portions 7*a* is 90%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Comparative Example 2.

Comparative Example 3

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 50 μm are arranged, and the area proportion of the adhesion surfaces 7*e* adhering to the adhesive layers 8 with respect to the surfaces 7*d* of the seat portions 7*a* is 80%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Comparative Example 3.

Comparative Example 4

An acrylic type ultraviolet curing adhesive is applied to the surfaces 7*d* of the seat portions 7*a*, which are similar to those of Example 1, by screen printing. The adhesive layers 8 in this case are formed in a dot pattern in which circular dots having an outer diameter of 600 μm are arranged, and the area proportion of the adhesion surfaces 7*e* adhering to the adhesive layers 8 with respect to the surfaces 7*d* of the seat portions 7*a* is 80%. On the other hand, the key tops 1, which are similar to those of Example 1, are formed. Finally, as in Example 1, the key tops 1 are fixed to the surfaces 7*d* of the seat portions 7*a* through the intermediation of the adhesive, thereby producing the key sheet of Comparative Example 4.

2. Evaluation of the Key Sheets

The key sheets thus produced were measured and evaluated for visibility and adhesive force in the following manner.

"Visibility": Each key sheet was placed on a light table containing a Standard Light Source D65 (JIS Z 8720), and the adhesive layers were evaluated from right above through the key tops with the naked eye; the evaluation results are as shown in Tables 1 and 2. In the tables, the symbol "O" indicates that the dot pattern of the adhesive layers are hard to visually recognize, and the symbol "x" indicates that bubble marks are visually recognizable (with Comparative Example 3 excluded).

"Adhesive Force": According to JIS K 6854-2 (180° peel test), the adhesive strength of the key tops and the base sheet was evaluated; the evaluation results are shown in Table 1. In the table, the symbol "O" indicates that the base sheet had been broken before the key tops or the base sheet was peeled off from the adhesive layers, and the symbol "x" indicates that the key tops or the base sheet was peeled off from the adhesive layers.

As shown in Table 1, in Comparative Example 1, in which the area proportion of the adhesion surfaces 7*e* adhering to the adhesive layers 8 with respect to the surfaces 7*d* of the seat portions 7*a* of the base sheet is 20%, the dot pattern of the adhesive layers is not visually recognizable. However, due to the weak adhesive force, the key sheet of Comparative Example 1 is not suitable for practical use. In Comparative Example 2, in which the area proportion of the adhesion surfaces 7*e* adhering to the adhesive layers 8 with respect to the surfaces 7*d* of the seat portions 7*a* of the base sheet is 90%, there is no such problem due to the large adhesion area of the adhesive layers 8. However, in terms of visibility, bubble marks were visually recognizable, so this comparative example could not meet the request in quality in terms of outward appearance. In contrast, in Examples 1 through 3, in which the area proportion of the adhesion surfaces 7*e* adhering to the adhesive layers 8 with respect to the surfaces 7*d* of the seat portions 7*a* of the base sheet ranges from 30% to 80%, the dot pattern of the adhesive layers 8 is hard to visually recognize, and the adhesive force exerted is of a sufficiently high level.

TABLE 1

| | Example 1 | Example 2 | Example 3 | Comparative Example 1 | Comparative Example 2 |
|---|---|---|---|---|---|
| Outer diameter (μm) | 300 | 300 | 300 | 300 | 300 |
| Area proportion of the adhesion surfaces adhering to the adhesive layers with respect to the surfaces of the seat portions (%) | 30 | 50 | 80 | 20 | 90 |
| Visibility | ○ | ○ | ○ | ○ | x |
| Adhesive Force | ○ | ○ | ○ | x | ○ |

Figure 9:
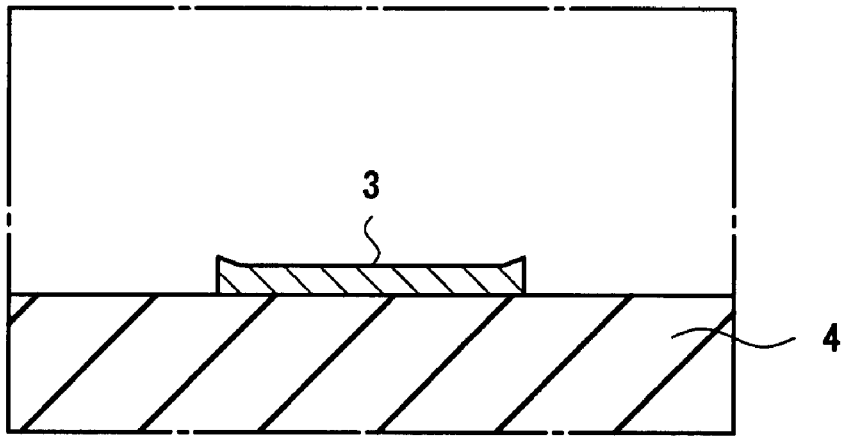
Fig.9 Related Art
FIG. 9 is an enlarged sectional view illustrating an adhesive layer of the conventional key sheet.
Figure 10:
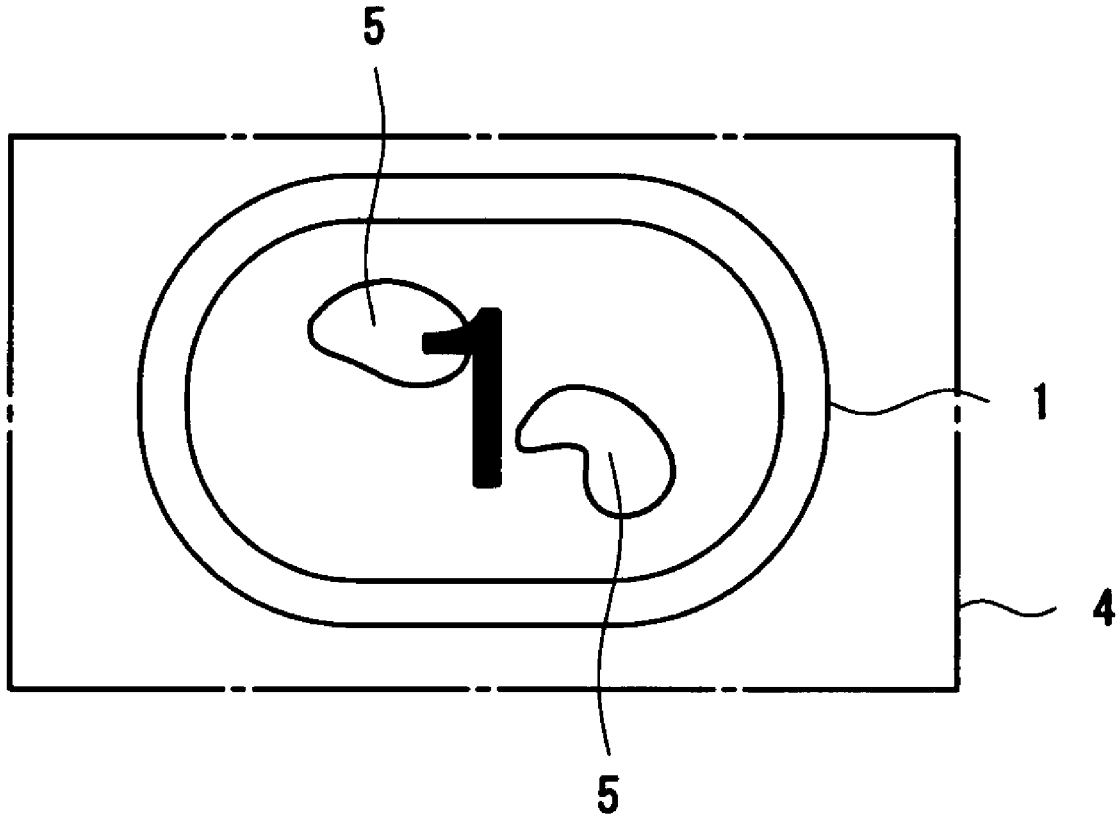
Fig.10 Related Art
FIG. 10 is a plan view of another conventional key sheet.

As shown in Table 2, in Comparative Example 3, in which the dot outer diameter is 50 μm, many dots were blurred and chipped, so the dot pattern composed of circular dots could not be formed with high accuracy. From this viewpoint, the visibility of Comparative Example 3 was evaluated as "x". In Comparative Example 4, in which the dot outer diameter is 600 μm, bubble patterns were to be observed in the adhesive layers 8. It is to be assumed that this is attributable to the fact that the outer edges of the adhesive layers are raised after the formation of the dot pattern as shown in FIG. 9, allowing bubbles to be easily trapped in the interfaces of the adhesive layers 8. In contrast, in Examples 3 through 5, in which the dot outer diameter ranges from 100 μm to 500 μm, the dot pattern of the adhesive layers 8 is hard to visually recognize, thus making it possible to meet the request in quality in terms of outward appearance.

TABLE 2

| | Example 3 | Example 4 | Example 5 | Comparative Example 3 | Comparative Example 4 |
|---|---|---|---|---|---|
| Outer diameter (μm) | 300 | 100 | 500 | 50 | 600 |
| Area proportion of the adhesion surfaces adhering to the adhesive layers with respect to the surfaces of the seat | 80 | 80 | 80 | 80 | 80 |

TABLE 2-continued

| | Example 3 | Example 4 | Example 5 | Comparative Example 3 | Comparative Example 4 |
|---|---|---|---|---|---|
| portions (%) | | | | | |
| Visibility | ○ | ○ | ○ | x | x |

What is claimed is:

1. A key sheet comprising:

a key top;

a base sheet to which the key top is fixed; and an adhesive layer existing between the key top and the base sheet, wherein the adhesive layer is a print layer in a fine pattern formed by pattern elements spaced apart from each other by gaps.

2. A key sheet according to claim 1, wherein the adhesive layer is formed in a regular dot pattern in plan view.

3. A key sheet according to claim 2, wherein the adhesive layer has one of a diameter and a diagonal length of the dot pattern elements ranging from 100 μm to 500 υm.

4. A key sheet according to claim 1, wherein the adhesive layer is formed in a regular line pattern in plan view.

5. A key sheet according to claim 3, wherein the adhesive layer has a line width of the line pattern elements ranging from 100 μm to 500 μm.

6. A key sheet according to claim 1, further comprising an area proportion of an adhesion surface adhering to the adhesive layer with respect to a bonding surface of the base sheet for the key top, the area proportion ranging from 30% to 80%.

7. A key sheet according to claim 1, wherein the key top has at its bottom a diffusion layer diffusing transmitted light.

8. A key sheet according to claim 1, wherein the adhesive layer contains 0.1% by mass to 15% by mass of an inorganic additive with respect to a resin solid portion.

9. A key sheet comprising:

a key top;

a base sheet to which the key top is fixed; and an adhesive layer existing between the key top and the base sheet, wherein the adhesive layer includes a plurality of pattern elements, spaced apart from each other by gaps and located directly below the key top.

10. A key sheet according to claim 9, wherein the adhesive layer is formed in a regular dot pattern in plan view.

11. A key sheet according to claim 9, wherein the adhesive layer is formed in a regular line pattern in plan view.

12. A key sheet according to claim 9, further comprising an area proportion of an adhesion surface adhering to the adhesive layer with respect to a bonding surface of the base sheet for the key top, the area proportion ranging from 30% to 80%.

13. A key sheet according to claim 9, wherein the key top has at its bottom a diffusion layer diffusing transmitted light.

14. A key sheet according to claim 9, wherein the adhesive layer contains 0.1% by mass to 15% by mass of an inorganic additive with respect to a resin solid portion.

15. A key sheet according to claim 10, wherein the adhesive layer has one of a diameter and a diagonal length of the dot pattern elements ranging from 100 μm to 500 υm.

16. A key sheet according to claim 11, wherein the adhesive layer has a line width of the line pattern elements ranging from 100 μm to 500 μm.

17. A key sheet according to claim 9, wherein the adhesive layer is a print layer in a fine pattern formed by the plurality of pattern elements.

18. A key sheet comprising:

a plurality of key tops;

a base sheet to which the plurality of key tops is fixed; and an adhesive layer existing between each key top of the plurality of key tops and the base sheet, wherein the adhesive layer includes a plurality of pattern elements, spaced apart from each other by gaps and located directly below the each key top.

19. A key sheet according to claim 18, wherein the adhesive layer is a print layer in a fine pattern formed by the plurality of pattern elements.

* * * * *